US009312056B2

(12) United States Patent
Hoffmann et al.

(10) Patent No.: US 9,312,056 B2
(45) Date of Patent: Apr. 12, 2016

(54) COIL ASSEMBLY

(71) Applicant: Phoenix Contact GmbH & Co. KG, Blomberg (DE)

(72) Inventors: Ralf Hoffmann, Berlin (DE); Olaf Abel, Werder (DE); Thomas Kuehne, Berlin (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 14/388,121

(22) PCT Filed: Mar. 27, 2013

(86) PCT No.: PCT/EP2013/056574
§ 371 (c)(1),
(2) Date: Sep. 25, 2014

(87) PCT Pub. No.: WO2013/144235
PCT Pub. Date: Oct. 3, 2013

(65) Prior Publication Data

US 2015/0061809 A1 Mar. 5, 2015

(30) Foreign Application Priority Data

Mar. 30, 2012 (DE) ..... 10 2012 006 434

(51) Int. Cl.

| | |
|---|---|
| ***H01F 27/30*** | (2006.01) |
| ***H01F 27/02*** | (2006.01) |
| ***H01F 27/29*** | (2006.01) |
| ***H01F 5/04*** | (2006.01) |
| ***H01F 5/02*** | (2006.01) |
| *H01H 49/00* | (2006.01) |

(52) U.S. Cl.
CPC .. *H01F 5/04* (2013.01); *H01F 5/02* (2013.01); *H01F 2005/043* (2013.01); *H01H 49/00* (2013.01); *Y10T 29/49071* (2015.01)

(58) Field of Classification Search
CPC ..... H01F 27/292; H01F 38/12; H01F 5/04; H01F 27/325; H01F 5/02
USPC ..... 336/83, 90, 192, 198, 208
See application file for complete search history.

(56) References Cited

U.S. PATENT DOCUMENTS

| | | | | |
|---|---|---|---|---|
| 3,095,635 | A * | 7/1963 | Laviana | 29/605 |
| 4,394,637 | A | 7/1983 | Petroons | |
| 4,912,438 | A | 3/1990 | Yokoo | |

(Continued)

FOREIGN PATENT DOCUMENTS

| | | | |
|---|---|---|---|
| DE | 8428722 | U1 | 8/1985 |
| EP | 308689 | A1 * | 3/1989 |

(Continued)

OTHER PUBLICATIONS

"Related International Application No. PCT/EP2013/056574", "International Preliminary Report on Patentability", Oct. 9, 2014, Publisher: International Bureau of WIPO, Published in: CH.

(Continued)

*Primary Examiner* — Tsz Chan
(74) *Attorney, Agent, or Firm* — Kaplan Breyer Schwarz & Ottesen, LLP

(57) ABSTRACT

A coil assembly is provided, comprising a coil former, a coil, and a connection block which is pivotally joined to the coil former. The coil is wound while the connection block is pivoted away, the winding wire ends are soldered to the terminal pins, and the connection block is pivoted close to the coil.

7 Claims, 8 Drawing Sheets

(56) References Cited

U.S. PATENT DOCUMENTS

| | | | | |
|---|---|---|---|---|
| 5,126,709 | A | 6/1992 | Tanaka et al. | |
| 5,153,543 | A | 10/1992 | Hitachi et al. | |
| 6,160,468 | A * | 12/2000 | Himei | 336/198 |
| 6,670,871 | B1 | 12/2003 | Saso et al. | |
| 2002/0135446 | A1 * | 9/2002 | Takano et al. | 335/128 |

FOREIGN PATENT DOCUMENTS

| | | | |
|---|---|---|---|
| EP | 1246214 | A1 | 10/2002 |
| EP | 2187418 | A2 | 5/2010 |
| JP | S56160096 | U | 11/1981 |
| JP | S5791209 | U | 6/1982 |
| JP | S6127606 | A | 2/1986 |
| JP | H06150798 | A | 5/1994 |
| JP | 2001217117 | A | 8/2001 |

OTHER PUBLICATIONS

"Related International Application No. PCT/EP2013/056574", "International Search Report and Written Opinion", Jul. 3, 2013, Publisher: PCT, Published in: EP.

"Japanese Office Action" dated Oct. 27, 2015, issued in parallel International Patent Application No. 2015-502333.

* cited by examiner

COIL ASSEMBLY

FIELD OF THE INVENTION

The invention relates to a method for producing a coil assembly and to such a coil assembly, in particular for use in a relay, the coil assembly comprising an insulating coil former as a winding support, with a coil wound around the winding support, and a connection block on the flange of the coil for connecting the winding wire ends to terminal pins.

BACKGROUND OF THE INVENTION

EP 2 187 418 A2 discloses a relay including a relay core member having a magnetic core, a yoke, a coil, and an insulating coil former in form of two frames, the second frame defining a coil flange with a connection block which projects beyond the coil axis and in which two terminal pins for the winding wire ends are secured. With this configuration of the relay core member, an installation length is resulting, which is greater than the actual length of the coil former when considering the length of the coil axis from coil flange to coil flange.

From DE 84 28 722 U1 a coil former is known, that has an excitation winding between peripheral end flanges, and a plastic bracket with a hinge-type joint integrally molded to one end flange can be latched at the other end flange after having been folded. With this configuration, the coil must not have a large length. The plastic bracket has fitting openings with terminal pins inserted therein, that can be soldered to the winding ends of the coil. Once the bracket has been folded, the terminal pins with their ends project beyond the periphery of the coil, without however compromising the length of the coil.

U.S. Pat. Nos. 4,912,438, 5,153 543, and 6,670,871 B1 disclose polarized relays comprising a coil assembly, with a rocking armature, and a base housing. The coil assembly comprises a magnetic core, a coil former, a wound coil, and a permanent magnet. The base housing is a plastic box which opens to the upper side, and which has stationary contact terminals and coil terminals on its end faces, and terminal pin on its lateral sides. The rocking armature is mounted on the permanent magnet above the coil assembly and the base housing and supports the movable contact terminals of the relay switches. Because of the lateral arrangement of the terminal pins, a narrow configuration of the relay is not possible.

SUMMARY OF THE INVENTION

The invention is based on the object to provide a coil assembly with coil, insulating coil former, and connection block, which has length as measured in the direction of the coil axis, that does not significantly exceed the length of the coil, that means which is shorter than the relay core member of EP 2 187 418 A2. The coil may have a large length. Further it is intended to exploit the space at the coil assembly to an optimum. In particular, the coil assembly shall be suitable for a relay, whose terminal pins extend from the radially outer region of the coil.

According to the invention, a method is proposed for producing a coil assembly which is suitable for being installed in a relay, and which comprises an insulating coil former as a winding support, a coil, and terminal pins for electrical connection to the coil. The insulating coil former which defines a coil axis is provided with a coil connection flange to which a connection block is pivotally attached. The connection block which accommodates the terminal pins partially embedded in an insulating block body is arranged in preparatory position in which it extends within the space outside the outer space of the coil required for winding. Then, a winding wire is wound around the coil former, and the winding wire ends are led out from the coil near the coil connection flange and connected to the associated terminal pins. Thereafter, the terminal pins are bent. As a next step, the connection block is bent with respect to the coil former about a deformation portion. This moreover leads to a strain relief for the winding wire. In this manner, a coil assembly can be obtained, in which the terminal pins virtually extend from within the coil winding space, and do not extent from a space in extension of the coil axis nor do they extend in planes laterally from the coil. So a coil assembly of a very short configuration when compared to the length of the coil is achieved. The coil assembly may be handled separately from a pole assembly in which an unmagnetized ferromagnetic body is to be magnetized to obtain a polarized relay.

The coil assembly according to the invention may be implemented in different variations. Many configurations use an extension fixed to the coil connection flange and having a flexible deformable joining area to the connection block which is pivoted from its preparatory position to its final position.

In a first embodiment, the extension is integrally connected to the connection block through a flexible deformable hinge portion.

In other embodiments, a metallic bending zone is provided on a metallic member which may be one of the terminal pins or a separate bending arm. It is also possible to obtain a connection of the connection block to the extension secured to the coil connection flange via a torsion element.

Exemplary embodiments of the invention will now be described with reference to the drawings.

DETAILED DESCRIPTION

Figure 1:
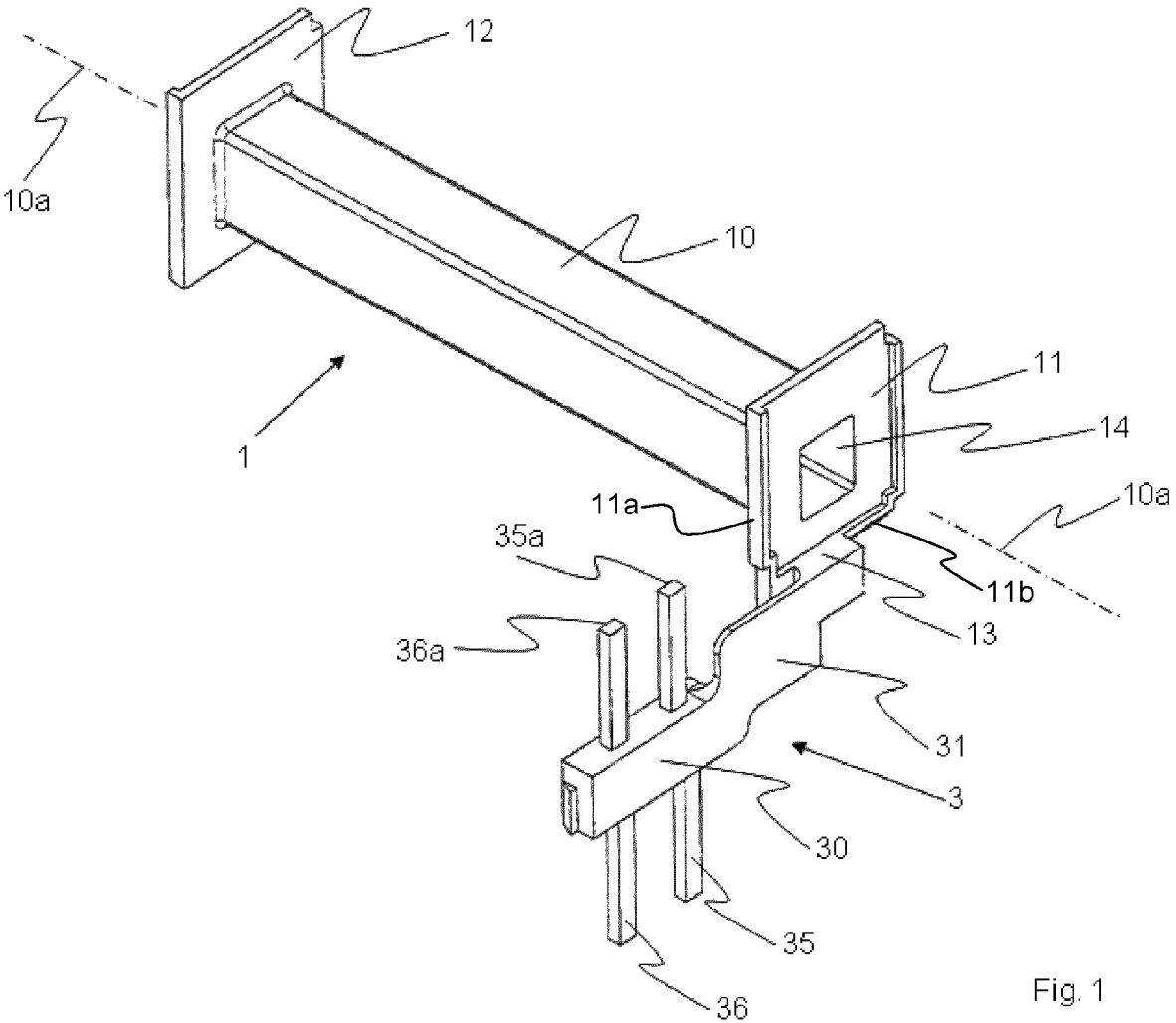
FIG. 1 shows a coil former with a coil connection flange and an integrally connected connection block, in a preparatory position.
Figure 2:
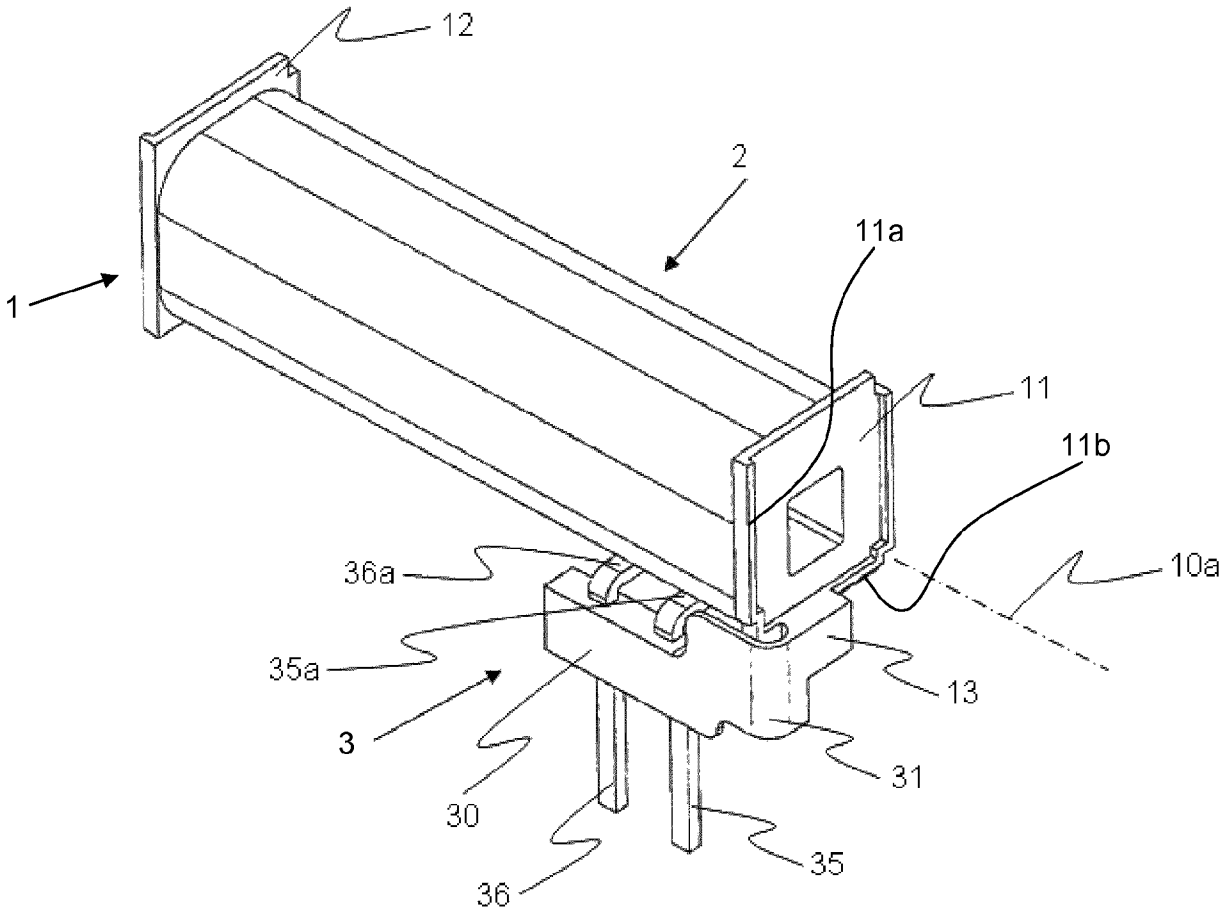
FIG. 2 shows the coil assembly with the connection block in the final position.

FIGS. 1 and 2 show a first embodiment of a coil assembly according to the invention. The main parts of the coil assembly are an insulating coil former 1, a coil 2, and a connection block 3 which can be pivoted from a preparatory position as seen in FIG. 1 to a final position as seen in FIG. 2. The coil former 1 has a coil tube 10 with a longitudinal cavity 14 which define a coil axis 10*a,* and two flanges 11 and 12 at the ends of coil tube 10. Flange 11 has peripheral edges, and the pivoting of connection block 3 is effected in extension of peripheral edge 11*a*. An extension 13 is secured to peripheral edge 11*b* of flange 11 and is integrally joined to connection block 3. Connection block 3 comprises an insulating block body 30 and a flexible deformable hinge portion 31 on the extension of peripheral edge 11*a*. Coil former 1 with flange extension 13, hinge portion 31, and block body 30 are made of electrically insulating material which is suitable for overmolding metallic parts. Such metallic parts are the terminal pins 35, 36 which are partially embedded in body block 30 and protrude from block body 30 with their ends 35*a,* 36*a*.

FIG. 1 shows the coil former 1 with connection block 3 in the preparatory position before the winding is placed around coil former. As can be seen, coil tube 10 between flanges 11 and 12 is accessible without hindrance from the lateral side, which means that the connection block 3 is located outside the contour of coil connection flange 11 and outside the required space for winding the coil winding. In this position of the connection block 3 the coil former 1 receives the winding thereby forming the coil 2 (FIG. 2) which has two winding wire ends, not shown, which are led out from the coil in the region of flange 11 and which are connected to terminal pins 35 and 36, for example by soldering. Subsequently, the upwardly projecting ends 35*a* and 36*a* of terminal pins 35, 36 are bent over into a plane in parallel to the coil axis 10*a*. Then, the hinge portion 31 of connection block 3, which together with its terminal pins 35 and 36 is located in a main plane transversely to the coil axis 10*a* (FIG. 1) is bent about an axis approximately in the extension of peripheral edge 11*a*, so that the block body 30 substantially extends in parallel to the coil axis 10*a,* as illustrated in FIG. 2.

The novel coil assembly is distinguished by a short installation length. In the installation space, the terminal pins 35, 36 will be arranged immediately beneath the coil 2, i.e. the width of flanges 11, 12 covers the terminal pins 35, 36. Therefore, the coil assembly is ideally suited for being installed into small or narrow relays, and also into relays having a long coil former 1.

Figure 3:
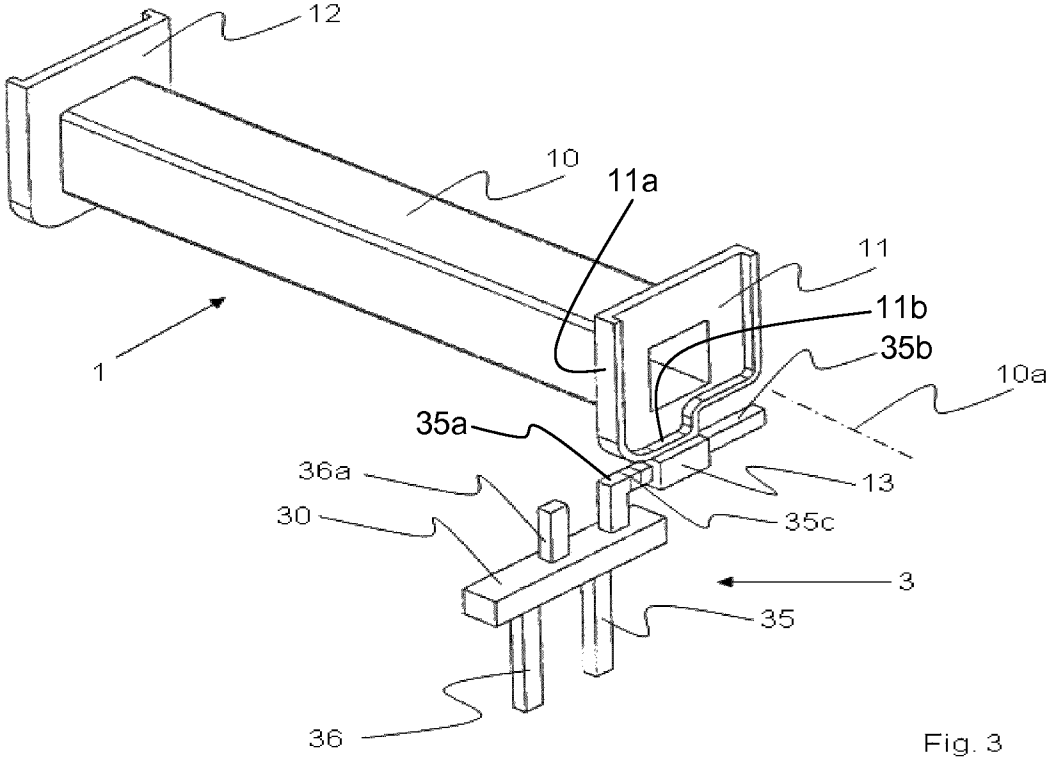
FIG. 3 shows a coil former with a coil connection flange and a connection block connected through a terminal pin, in the preparatory position.
Figure 4:
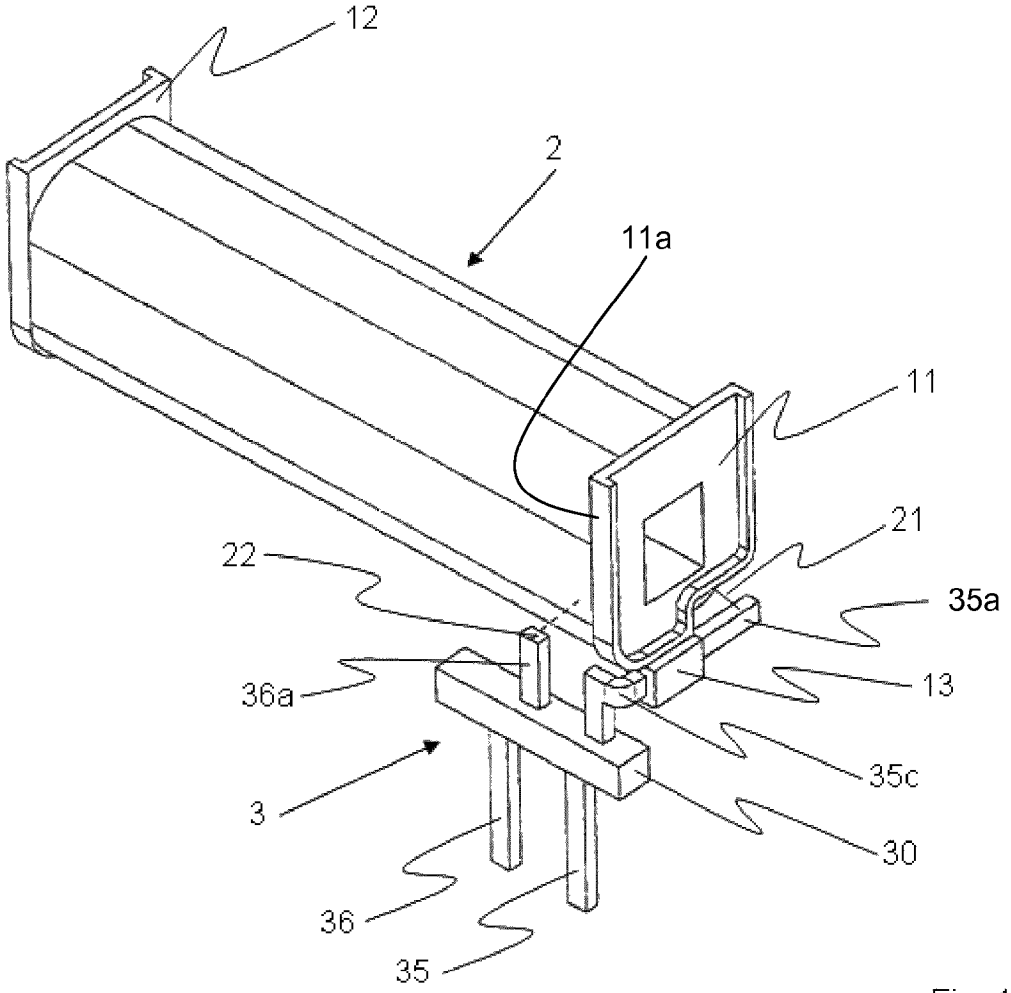
FIG. 4 shows the coil assembly with the connection block of FIG. 3 in the final position.

FIGS. 3 and 4 illustrate a further embodiment of the novel coil assembly. Similar parts are designated with the same reference numerals as in the embodiment of FIGS. 1 and 2. The principal difference is the connection between flange extension 13 and block body 30. In fact, a cranked terminal pin 35 is used for this purpose, which is deflected at its the upper end 35*a* and has an angled section 35*b* which is anchored in flange extension 13. Additionally, terminal pin 35 has a bending zone 35*c* between sections 35*a* and 35*b*, which is located approximately on the extension of peripheral edge 11*a*. Terminal pin 36 is also cranked, as seen from the projecting end 36*a*. Coil 2 is wound around coil former 1 in the manner described before, while connection block 30 is arranged in its preparatory position as seen in FIG. 3. Then, the winding wire ends 21 and 22 are soldered or otherwise connected to terminal pin ends 35*a* and 36*a*. Afterwards, terminal pin 35 is bent about its bending zone 35*c* so that connection block 3 assumes the final position illustrated in FIG. 4 in which the main plane of the connector block 30 is in parallel to coil axis 10*a*.

Figure 5:
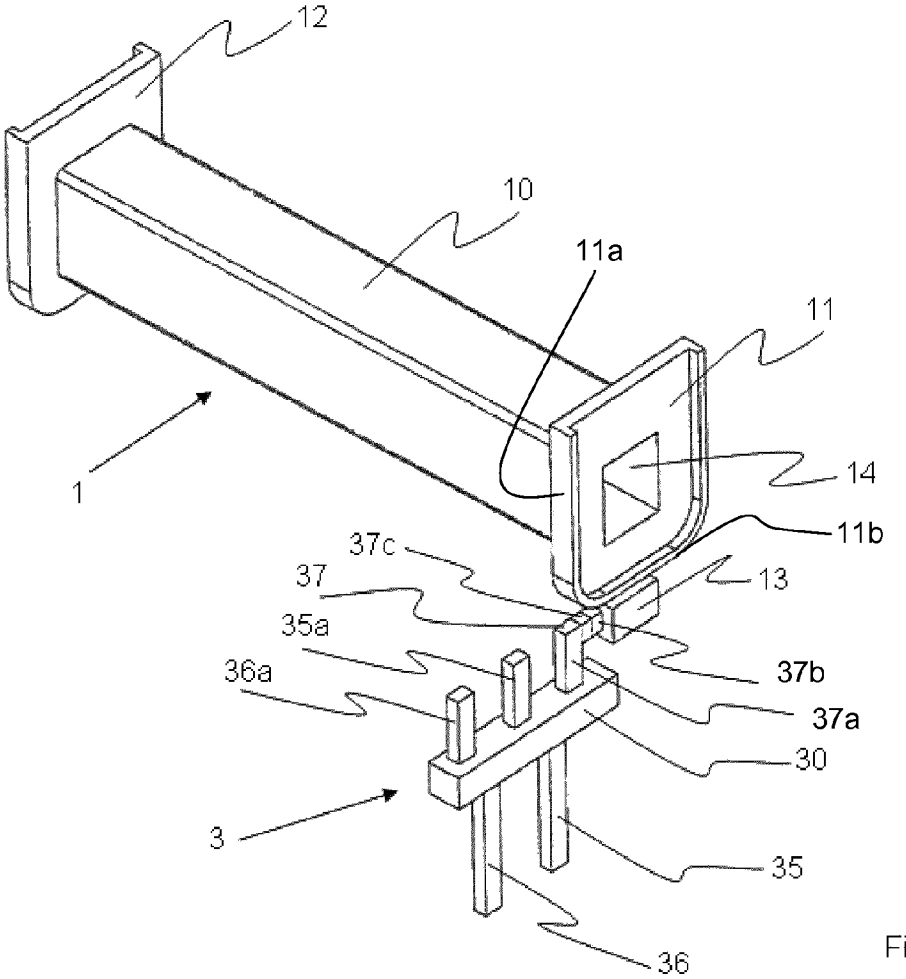
FIG. 5 shows a coil former with a coil connection flange and a connection block connected through a bending arm, in the preparatory position.
Figure 6:
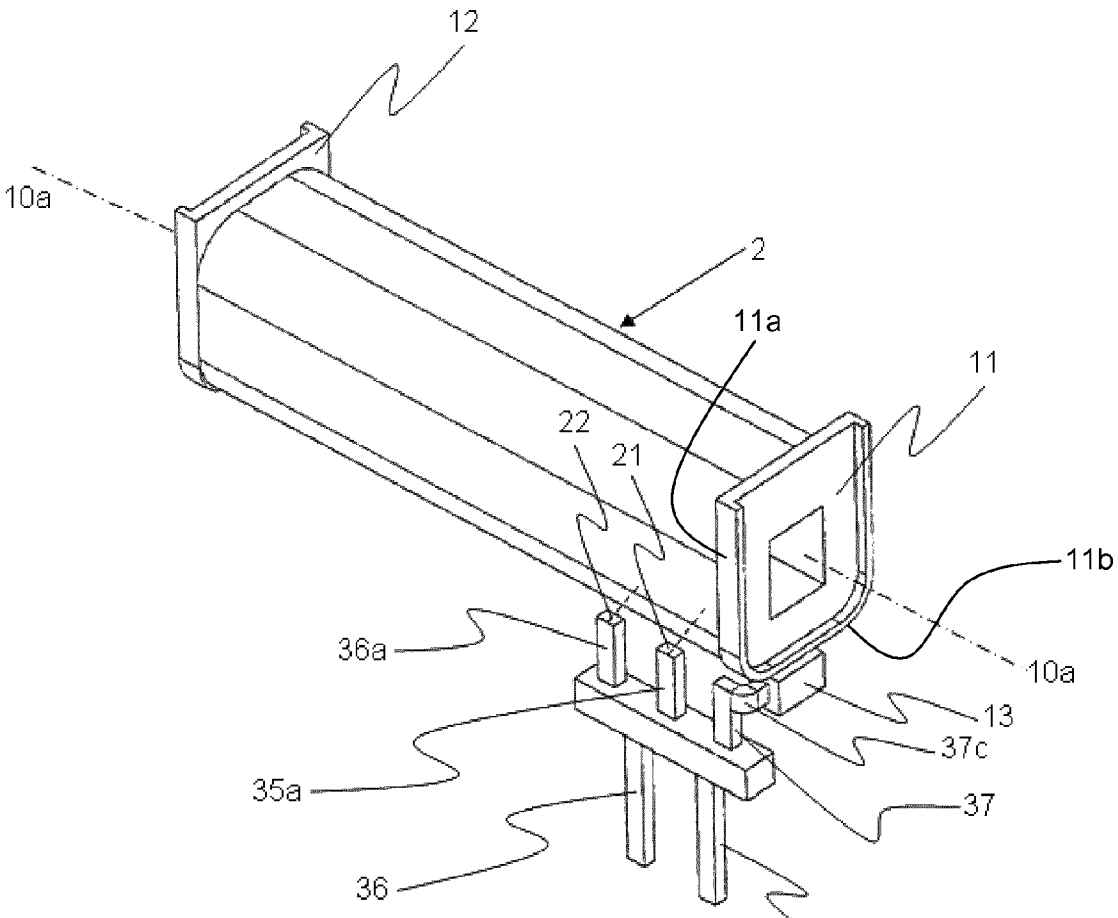
FIG. 6 shows the coil assembly of FIG. 5 with the connection block bent close to the coil.

FIGS. 5 and 6 show a third embodiment of the invention. Equivalent parts are designated with the same reference numerals. The characteristic feature of the third embodiment is a bending arm 37 which has a first leg 37*a* anchored in block body 30, while the second leg 37*b* is anchored in flange extension 13. Bending arm 37 may be an angled part similar to sections 35*a,* 35*b,* and 35*c* of terminal pin 35, which may additionally have a cranked fork end 35*a*. The winding is applied around coil former 1, and wire ends 21, 22 are electrically conductively connected to the free ends 35*a* and 36*a* of terminal pins 35, 36. As described above, connection block 3 is pivoted from its preparatory position illustrated in FIG. 5 to the final position shown in FIG. 6, whereby the bending zone 37*c* of bending arm 37 is permanently deformed.

Figure 7:
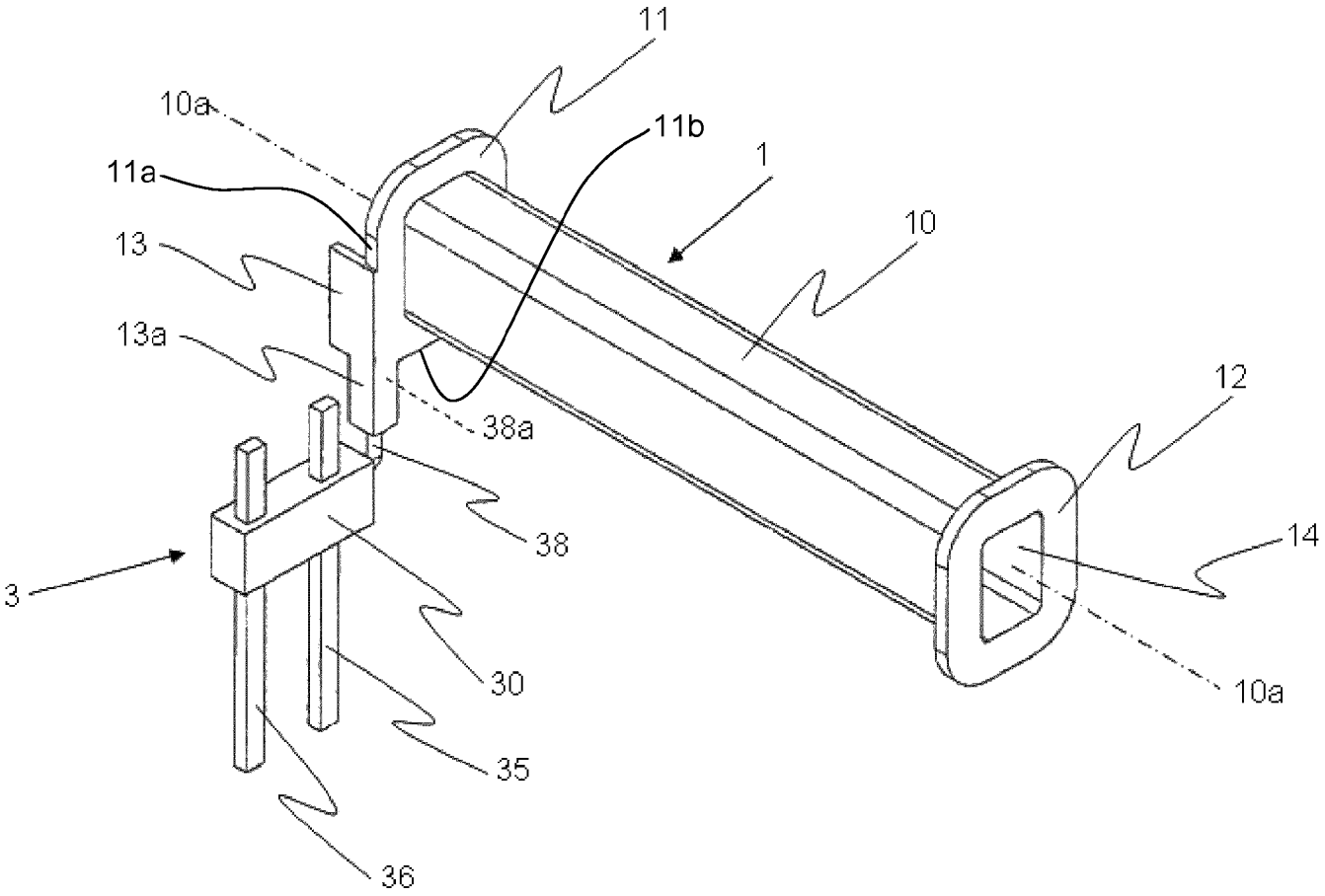
FIG. 7 shows a coil former with coil connection flange, which is connected with the connection block via a torsional joint.
Figure 8:
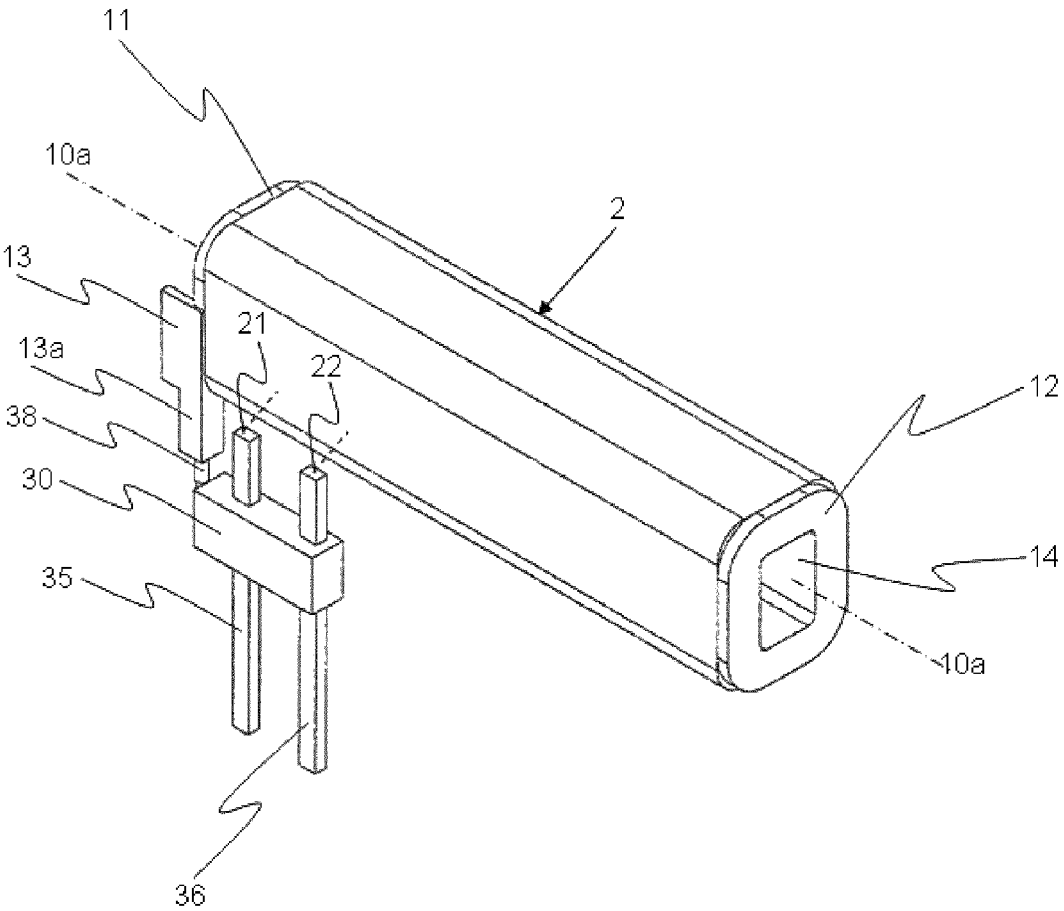
FIG. 8 shows the coil assembly of FIG. 7 with the connection block in the final position.

FIGS. 7 and 8 show a fourth embodiment of the invention. The same reference numerals as before are used. Extension 13 on coil connection flange 11 has a downwardly extending projection 13*a* for accommodating a torsion leg 38*a* of an elbow-shaped joining member 38. The angled leg of joining member 38 extends into and is anchored in block body 30. In the preparatory position as seen in FIG. 7, the main plane of connection block 3 extends transversely to the coil axis 10*a,* and in this preparatory position the coil 2 is wound, whereupon the winding wire ends 21, 22 are soldered or otherwise conductively connected to their respective terminal pins 35, 36. Thereafter, connection block 3 is pivoted from the position of FIG. 7 into the position of FIG. 8, whereby the torsion leg 38*a* of the elbow-shaped joining member 38 is twisted and undergoes permanent deformation.

It will be apparent to those skilled in the art that the embodiments described above are intended as examples and that the invention is not limited thereto but may be varied in many ways without departing from the scope of the claims. Furthermore, the features also define individually significant components of the invention, irrespective of whether they are disclosed in the description, the claims, the figures, or otherwise, even if they are described together with other features.

What is claimed is:

1. A method for producing a coil assembly suitable for being installed in a relay and comprising an insulating coil former as a winding support, a coil having a coil end with winding wire ends and terminal pins for electrical connection to the coil, comprising the steps of:

a) providing the insulating coil former which defines a coil axis and has a coil connection flange which includes:

a first peripheral edge defining an axis which extends approximately in extension of the first peripheral edge, a second peripheral edge perpendicular to the first peripheral edge, an extension which is fixed to the second peripheral edge, and a connection block accommodating the terminal pins and being joined by a deformation section to the extension;

b) winding a winding wire around the coil former to produce the coil, and leading out the winding wire ends close to the coil end at the coil connection flange;

c) connecting the terminal pins to associated winding wire ends; and d) pivoting or twisting the connection block about said axis extending approximately in extension of the first peripheral edge of the coil connection flange into a final position overlapping the coil winding space, while said deformation section is permanently bent or permanently twisted.

2. A coil assembly, comprising:

an insulating coil former as a winding support, which defines a coil axis and has a coil connection flange mounted on an axial end of the insulating coil former, the coil connection flange including:

a first peripheral edge defining an axis which extends approximately in extension of the first peripheral edge, a second peripheral edge perpendicular to the first peripheral edge, an extension which is fixed to the second peripheral edge, and a connection block accommodating at least a first and a second terminal pin and being joint by a deformation section to the extension, and a coil wound around the coil former and having winding wire ends which are connected to the at least first and second terminal pins when the coil assembly is completed;

wherein said deformation section between the connection block and the extension is a joining area that is permanently deformable by being bent or twisted from a preparatory position outside a coil winding space required for winding, and is to be pivoted or twisted into a final position overlapping the coil winding space when the winding has been completed.

3. The coil assembly as claimed in claim 2, wherein said deformation section is a flexible permanently deformable hinge portion which enables to position the connection block with the terminal pins from a preparatory position into the final position.

4. The coil assembly as claimed in claim 3, wherein, in the preparatory position, the terminal pins are in a plane transversely to the coil axis, and wherein, in the final position the ends of the terminal pins proximal to the coil are bent into a plane in parallel to the coil axis.

5. The coil assembly as claimed in claim 2, wherein the first terminal pin has a first leg extending approximately in extension of the first peripheral edge, and a second, deflected leg extending through the extension;

wherein the first leg as well as the second terminal pin extend through an insulating block body of the connection block; and wherein the second deflected leg of the first terminal pin has a bending zone as said deformation section for bending the first terminal pin to bring the connection block from its preparatory position transversely to the coil axis to its final position in parallel to the coil axis.

6. The coil assembly as claimed in claim 2, wherein a bent member has a first leg extending approximately in extension of the first peripheral edge and being anchored in an insulating block of the connecting block, and a second, deflected leg which is anchored in said extension and has, as said deformation section, a bending zone for bending the second leg to bring the connection block from its preparatory position transversely to the coil axis into its final position in parallel to the coil axis.

7. The coil assembly as claimed in claim 2, wherein an elbow-shaped joining member has a first, torsion leg extending approximately in extension of the first peripheral edge and being anchored in the extension, and a second leg is anchored in an insulating block body of the connection block; and wherein the connection block with its terminal pins is to be brought from its preparatory position transversely to the coil axis to its final position in parallel to the coil axis by twisting and permanently deforming the torsion leg.

* * * * *